United States Patent [19]

Pav et al.

[11] 4,235,002

[45] Nov. 25, 1980

[54] ROTARY UNIT FOR USE IN CALENDARS OR THE LIKE

[75] Inventors: Josef Pav; Michael Jäkel; Dieter Junk, all of Krefeld, Fed. Rep. of Germany

[73] Assignee: Kleinewefers GmbH, Krefeld, Fed. Rep. of Germany

[21] Appl. No.: 25,651

[22] Filed: Mar. 30, 1979

[30] Foreign Application Priority Data

Apr. 3, 1978 [DE] Fed. Rep. of Germany ..... 2814244

[51] Int. Cl.[3] ..... F28F 5/02

[52] U.S. Cl. ..... 29/110; 165/89; 308/20

[58] Field of Search ..... 29/110, 123; 165/89, 165/90, 87, 88; 308/20

[56] References Cited

U.S. PATENT DOCUMENTS

| | | | |
|---|---|---|---|
| 2,531,988 | 11/1950 | Price | 165/89 |
| 3,129,755 | 4/1964 | Gould et al. | 165/89 |
| 3,881,233 | 5/1975 | Schmidt et al. | 29/110 |
| 4,107,831 | 8/1978 | Siegfried | 29/123 |

*Primary Examiner*—Lenard A. Footland
*Attorney, Agent, or Firm*—Peter K. Kontler

[57] ABSTRACT

A rotary cylinder for use in a calender has a roller with a hollow cylindrical sleeve and two trunnions secured to the end portions of the sleeve. The roller contains a coaxial displacing component which defines with the sleeve an annular clearance for the flow of a cooling or heating fluid, such fluid being admitted through one of the trunnions and being evacuated through the one or the other trunnion. One or more prestressed elastic cushions are interposed between the displacing component and the roller to compensate for and to counteract eventual radial and or axial movements of a portion of or the entire displacing component as a result or unequal heating or cooling of the roller and displacing component. A single cushion may constitute a hollow conical frustum or a hollow cylinder. If the roller contains several cushions, such cushions may constitute discrete disks or ribs which are integral with the displacing component and contact the internal surface of the sleeve.

33 Claims, 14 Drawing Figures

ROTARY UNIT FOR USE IN CALENDARS OR THE LIKE

BACKGROUND OF THE INVENTION

The present invention relates to improvements in internally heated or cooled rotary units which can constitute the cylinders of calenders or analogous machines, and more particularly to improvements in rotary units of the type wherein a fluid heat exchange medium is caused to flow between the internal surface of the cylindrical shell or sleeve of a hollow roller-shaped first component and the exterior of a displacing component or torpedo which is inserted into the interior of the sleeve. Still more particularly, the invention relates to improvements in rotary units wherein the end portions of the sleeve or shell are connected with trunnions and the heat exchange medium enters the interior of the first component by way of one trunnion to leave the first component by way of the other trunnion or wherein the heat exchange medium enters and leaves the first component by way of one and the same trunnion.

It was already proposed to install in the interior of a hollow roller an elongated tubular displacing component and to convey the heat exchange medium through an annular clearance between the internal surface of the shell or sleeve of the roller and the external surface of the displacing component. Spent heat exchange medium can be conveyed into the interior of the displacing component and evacuated from the displacing component by way of that trunnion which admits fresh heat exchange medium. In a presently known construction, one end of the displacing component is secured to one of the trunnions and the other end of the displacing component carries projections which abut against the other trunnion. If the roller is to be heated from within, the displacing component (whose mass is relatively small) expands prior to expansion of the bulkier roller. This is the case when the roller is used to apply pressure to a web of paper which passes through a calender. In such machines, the roller must withstand pronounced deforming stresses and, therefore, its shell or sleeve is thick so that it can withstand high bending or flexing forces. As a rule, the heat-induced expansion of the displacing component is much more pronounced than the heat-induced expansion of the roller when the heating operation begins, i.e., when a stream of hot gaseous or hydraulic fluid begins to flow into the interior of the roller. The differences between the extent of heat-induced expansion of the roller on the one hand and the extent of heat-induced expansion of the displacing component on the other hand can cause damage to the roller and/or other inconveniences. In the aforediscussed conventional construction, that end of the displacing component which is not fixedly secured to the adjacent trunnion is slidably guided in the neighboring portion of the shell. To this end, the unconnected end of the displacing component carries projections which are slidable in the roller. Such construction does not permit for radial expansion of the displacing component with respect to the roller except if the initial mounting of the displacing component is such that the projections are spaced apart from the internal surface of the shell. Loose mounting of the displacing component is undesirable because, once the temperature of the roller matches the temperature of the displacing component, the clearances between the projections and the shell reappear so that the respective end portion of the displacing component is free to perform stray (radial) movements with respect to the roller. This results in repeated contact between the displacing component and the roller with attendant vibrations, noise and other undesirable effects including premature destruction of the displacing component.

The problems which arise as a result of the ability of an end portion of the displacing component to move radially with respect to the roller are aggravated if the roller is very long, if the outer diameter of the roller is large and/or if the difference between the temperature of the displacing component and the temperature of the roller is very pronounced. Such situation can arise in the cylinders of modern supercalenders for treatment of paper webs wherein the length of a calender roller is approximately 8 meters and its outer diameter is approximately 500 mm. The rollers are driven at a peripheral speed of 500 m/min, and the temperature of the heat exchange medium is in excess of 100° C.

OBJECTS AND SUMMARY OF THE INVENTION

An object of the invention is to provide a rotary unit which may constitute one of the cylinders in a calender or an analogous machine and wherein the displacing component is mounted in the hollow roller-shaped component in a novel and improved way.

Another object of the invention is to provide a novel and improved roller-shaped component for use in a rotary unit of the above outlined character.

A further object of the invention is to provide a novel and improved displacing component for use in the aforementioned rotary unit.

An additional object of the invention is to provide novel and improved means for compensating for and counteracting the movements of certain portions of or the entire displacing component with respect to the roller-shaped component.

A further object of the invention is to provide a rotary unit wherein uneven heating or cooling of the roller-shaped component and displacing component does not result in excessive vibratory or other stray movements of the displacing component and/or in damage to or destruction of the one and/or the other component.

An ancillary object of the invention is to provide a rotary unit wherein the displacing component is movable, within limits, axially and/or radially of the roller-shaped component but such movements are invariably counteracted by the aforementioned compensating means.

The invention resides in the provision of a rotary unit which may constitute a cylinder in a calender or a like machine. The rotary unit comprises a first component which constitutes a hollow roller including an elongated hollow cylindrical sleeve and first and second trunnions which are provided at and are preferably separably fastened to the end portions of the sleeve. The rotary unit further comprises an elongated second component (hereinafter called displacing component) which is coaxially mounted in the first component and defines with the sleeve an annular clearance for the flow of a fluid heat exchange medium (e.g., a gas or a liquid which serves to cool or heat the sleeve of the first component). At least one of the trunnions has channel means for admission of the heat exchange medium into and for evacuation of spent heat exchange medium from the clearance (the heat exchange medium can enter through one of the trunnions and leave through the other trunnion, or such heat exchange medium can enter and leave the rotary unit through one and the same trunnion). At least a certain portion (e.g., an end portion) of the displacing component is movable with respect to the first component in the radial and/or axial direction of the sleeve (e.g., in response to uneven heating or cooling of the two components). The rotary unit further comprises compensating means for eventual radial and/or axial movements of the displacing component with respect to the first component. The compensating means comprises at least one elastic cushion which is installed in prestressed condition and is interposed between the first component and the movable portion of the displacing component. The first component has a cylindrical or conical surface which is coaxial with the sleeve and is in permanent contact with the cushion, and the cushion is deformable in response to radial and/or axial movement of the aforementioned portion of the displacing component with respect to the sleeve.

The cushion may constitute a hollow conical frustum or a hollow cylinder. If the compensating means comprises several cushions, such cushions may constitute discrete disks or they can constitute integral parts of the displacing component. In the latter instance, the entire displacing component or at least the major part of the displacing component may consist of elastomeric material.

The novel features which are considered as characteristic of the invention are set forth in particular in the appended claims. The improved rotary unit itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
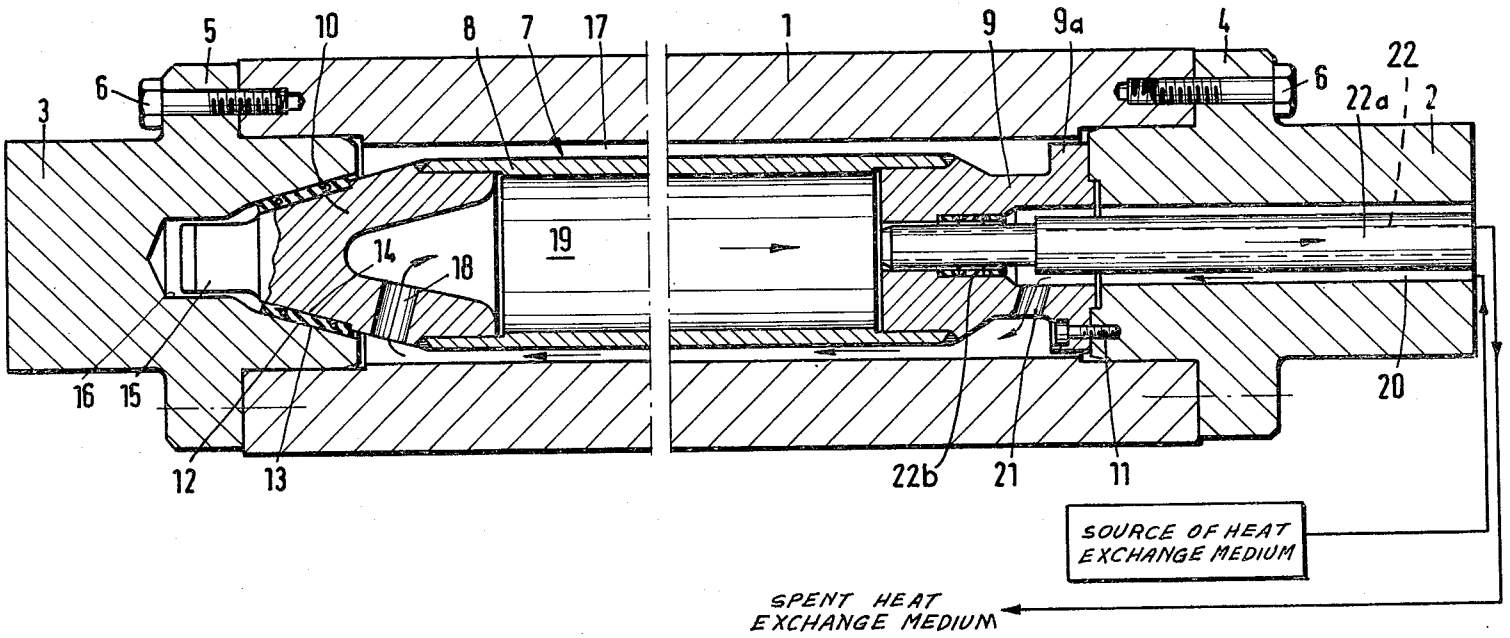
FIG. 1 is an axial sectional view of a rotary unit which embodies one form of the invention and comprises a single hollow frustoconical cushion interposed between a trunnion of the first component and a conical end portion of the displacing component.

FIG. 1 shows a rotary unit which constitutes one cylinder of a calender. The rotary unit includes a hollow roller-shaped first component (hereinafter called roller) which comprises a relatively thick cylindrical sleeve or shell 1 and two separable trunnions or stubs 2, 3. The trunnions 2, 3 are respectively provided with flanges 4, 5 which abut against the adjacent end faces at the respective ends of the sleeve 1 and are secured thereto by screws 6 or other suitable fasteners. The roller including the sleeve 1 and trunnions 2, 3 is heatable from within and contains a coaxial displacing component 7 which comprises a hollow tubular element 8. The end portions of the tubular element 8 are connected with closures or plugs 9 and 10. The plug 9 extends partially into the right-hand end portion of the element 8 and is welded thereto. The exposed outer end portion of the plug 9 includes a flange **9*a* which is fixedly but separably secured to the adjacent trunnion 2 by screws 11 or like removable securing means. The right-hand end portion of the plug 10 extends into the left-hand end portion of the element 8 and is welded thereto. However, the exposed portion of the plug 10 is not positively secured to the roller, i.e., to the sleeve 1 and/or trunnion 3. The exposed part of the plug 10 includes a conical portion which tapers in a direction away from the trunnion 2 and a coaxial cylindrical centering pin 15 which is received, with axial and radial clearance, in a socket or blind bore 16 of the trunnion 3**.

A compensating device consisting of a hollow frustoconical cushion 12 of elastomeric material (such as rubber) is inserted between the conical portion of the plug 10 and the trunnion 3, i.e., between the roller and the displacing component 7. The cushion 12 surrounds the conical external surface 14 of the plug 10 and is surrounded by the conical internal surface 13 of the trunnion 3. The thickness of the cushion 12, the distance between the trunnions 2 and 3, the dimensions of the internal conical surface 13 and the dimensions of the conical external surface 14 are selected in such a way that the cushion 12 is invariably maintained in prestressed condition when the trunnions 2, 3 are properly secured to the respective end portions of the sleeve 1.

The sleeve 1 of the roller is heated from within by a gaseous or liquid heat exchange medium which is circulated along a path, portions of which extend through the roller and through the displacing component 7. As shown in FIG. 1, the cylindrical peripheral surface of the tubular element 8 defines with the cylindrical internal surface of the sleeve 1 an elongated annular clearance 17 which communicates with the internal space 19 of the displacing component 7 by one or more substantially radially extending passages 18 in the plug 10. The right-hand end portion of the clearance 17 receives heat exchange medium from a coaxial channel 20 which is machined into right-hand trunnion 2. The connection between the channel 20 and the clearance 17 includes one or more substantially radially extending passages 21 machined into the plug 9. The plug 9 has an axial bore the right-hand portion of which constitutes an extension of the channel 20 in the trunnion 2. The channel 20 surrounds a pipe **22*a* which defines a second channel 22 communicating with the right-hand portion of the internal space 19. The left-hand portion of the pipe 22*a* extends into the smaller-diameter left-hand portion of the axial bore in the plug 9 and is surrounded by a sealing element 22*b*. The direction in which the heat exchange medium circulates (from the channel 20 into the clearance 17 via passage or passages 21, from the clearance 17 into the internal space 19 via passage or passages 18, and from the internal space 19 into the channel 22**) is indicated by arrows.

When the machine which embodies the rotary unit of FIG. 1 is idle, the circulation of heat exchange medium through the roller and the displacing component 7 is interrupted. Therefore, the temperature of the roller matches that of the displacing component. Nevertheless, the cushion 12 is held in prestressed condition owing to the aforediscussed dimensioning of conical surfaces 13, 14, thickness of the cushion and distance between the trunnions 2 and 3. When the rotary unit is to be put to use, it is heated by a heat exchange medium which is caused to flow into the channel 20 (e.g., the medium can be a liquid which is maintained at a temperature in excess of 100° C., for example, 130° C.). Since the mass of the displacing component 7 is relatively small, it is heated more rapidly than the heavier and bulkier roller. The right-hand end portion of the displacing component 7 is fixedly secured to the trunnion 2 by means of screws 11; however, the left-hand end portion of the displacing component 7 can expand in a direction away from the trunnion 2 to thereby cause further compression of the cushion 12. Radial expansion of the plug 10 is also taken up by the cushion 12, i.e., the latter is or can be deformed in the axial and/or radial direction of the sleeve 1.

If the left-hand portion of the displacing component 7 tends to vibrate while the roller is driven at a high speed, vibratory movements of the plug 10 are automatically damped by the cushion 12. Thus, certain portions of the cushion 12 (as considered in the circumferential direction of the conical surface 13 or 14) expand and certain other portions are compressed as a result of vibratory movements of the plug 10. However, initial stressing of the cushion 12 is sufficiently pronounced to insure that the cushion remains in full contact with each of the conical surfaces 13 and 14, even if the plug 10 is caused to perform pronounced vibratory movements substantially radially of the sleeve 1. This insures that the surfaces 13, 14 cannot be damaged as a result of direct impact of the plug 10 against the inner portion of the trunnion 3.

The rotary unit of FIG. 1 can be modified by replacing the trunnion 2 with a trunnion which is similar to the trunnion 3 and by replacing the plug 9 with a plug which is similar to the plug 10. A second cushion 12 is then inserted between the right-hand trunnion and the right-hand plug, and the screws 11 are omitted. In other words, neither of the two end portions of the displacing component 7 must be fixedly secured to the roller. If the displacing component 7 is mounted between two cushions, one at each of its ends, the cushions are subjected to sufficiently high initial deforming stressed to insure that the displacing component invariably rotates with the roller as a result of frictional engagement between the cushions and the adjacent surfaces of the respective trunnion and plug. An advantage of the just described modification of the rotary unit of FIG. 1 is that each of the two cushions can compensate for or suppress stray (radial) movements of the respective end portion of the displacing component. Moreover, the cushions can compensate for more pronounced axial and/or radial expansion or contraction of the displacing component with respect to the roller and/or vice versa.

Once the roller is heated to the temperature of the displacing component 7, the stress upon the cushion or cushions 12 is reduced; however, the initial stress (prestressing) invariably suffices to insure that the cushion or cushions remain in full contact with the adjacent portions of the roller and displacing component.

An important advantage of the improved rotary unit is that the elastic cushion 12 is capable of yielding in response to radial and/or axial movements of the displacing component 7 with respect to the roller. Therefore, and in view of initial stressing of the cushion, the latter remains in permanent contact with the two components and not only absorbs but also opposes undesirable movements of a portion (10) of or the entire displacing component with respect to the roller. This is especially important when the heating or cooling of the roller begins, i.e., during the initial stage of admission of a heat exchange medium into the clearance 17 when the bulkier roller is less likely to be heated or cooled to the same extent as the displacing component. When the roller is already heated to the temperature of the displacing component, the radial and/or axial movements of the displacing component are terminated and the prestressed cushion insures that the displacing component is coaxial with the roller. Radial movements of the displacing component, which take place under the action of centrifugal force or for other reasons when the temperature of the roller matches that of the displacing component, are also damped by the cushion 12. Thus, and as explained above, radial movements (vibrations) of the plug 10 with respect to the sleeve 1 result in compression of certain portions and in simultaneous expansion of other portions of the cushion 12 while the latter remains in full contact with the conical surfaces 13 and 14. The damping action is assisted by inherent hysteresis of elastomeric material of the cushion 12 which converts the work needed for radial movement of the plug 10 into heat energy. An additional advantage of the cushion 12 is that it can compensate for eventual tolerances in the machining of the roller and/or displacing component.

A further important advantage of the rotary unit of FIG. 1 is that the compensating device is very simple and inexpensive, i.e., such compensating device consists of a cushion 12 which constitutes a hollow conical frustum. The inner and outer surfaces of the frustum are in direct and permanent contact with the surfaces 13 and 14 of the roller (trunnion 3) and (plug 10 of the) displacing component 7. Moreover, initial stressing of the cushion 12 is completed in automatic response to proper attachment of the trunnions 2 and 3 to the respective end portions of the sleeve 1.

Figure 2:
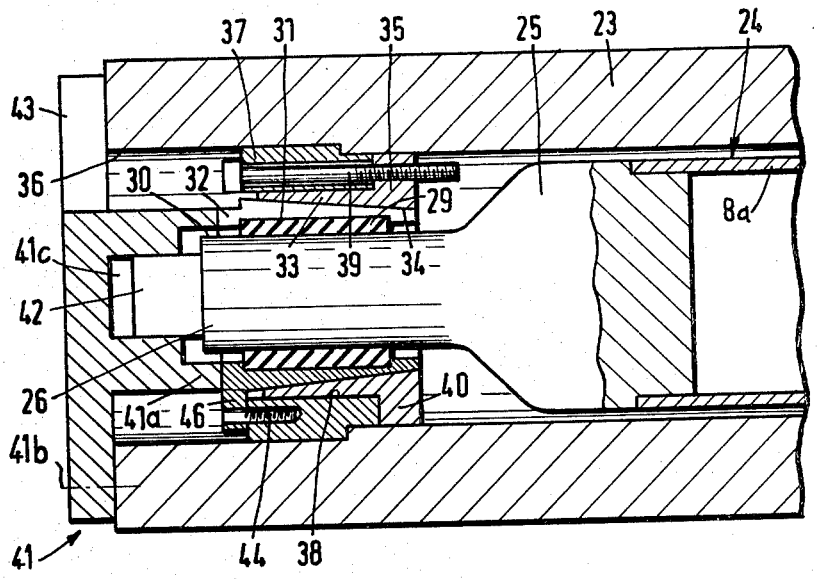
FIG. 2 is a fragmentary axial sectional view of a partly assembled second rotary unit wherein a cylindrical cushion surrounds a coaxial extension of the displacing component and is surrounded by a radially deformable chuck of the first component.
Figure 3:
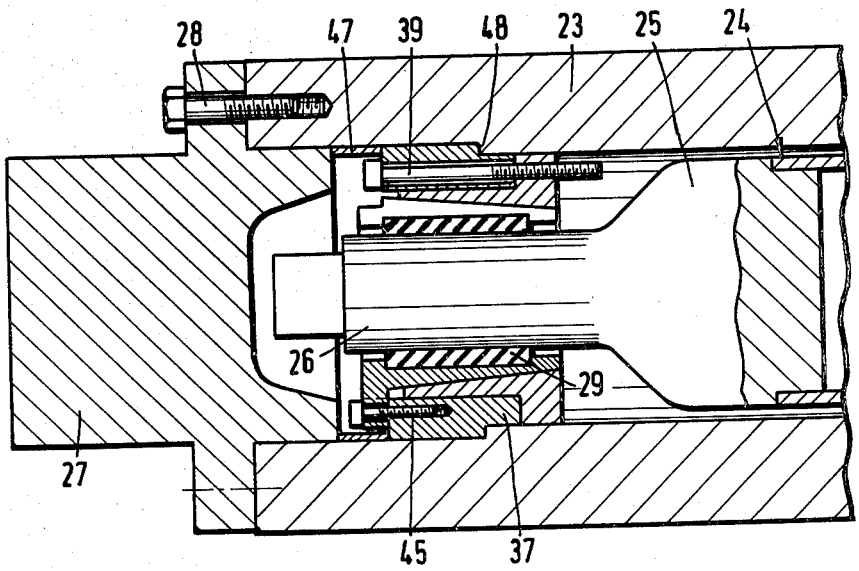
FIG. 3 illustrates the structure of FIG. 2 in the fully assembled condition.

In the rotary unit of FIGS. 2 and 3, the first component or roller comprises a hollow cylindrical sleeve 23 which surrounds and is spaced apart from an elongated coaxial displacing component 24. The latter comprises a tubular element 8*a* and two end portions or plugs one of which is shown at 25. The exposed portion of the plug 25 tapers in a direction away from the element 8*a* and includes a smaller-diameter cylindrical extension or stub 26 with a coaxial guide pin 42 extending into the coaxial blind bore or socket of an annular holding device 41 constituting a temporary closure for the respective end of the sleeve 23. When the roller including the sleeve 23 is fully assembled, the holding device or temporary closure 41 is replaced with a trunnion 27 which is shown in FIG. 3 and is detachably secured to the sleeve 23 by screws 28 or analogous fasteners.

The compensating device comprises a hollow cylindrical cushion 29 between the cylindrical extension 26 of the plug 25 and the sleeve 23 of the roller. The cushion 29 surrounds the cylindrical external surface 30 of the extension 26 and is surrounded by the cylindrical internal surface 31 of a multi-pronged composite or one-piece chuck 32. For example, the chuck 32 may comprise three prongs each of which extends along an arc of approximately 120 degrees, as considered in the circumferential direction of the hollow cylindrical 29. The conical external surface 33 of the chuck 32 (i.e, of the three prongs of the chuck) is in contact with a complementary conical internal surface 34 of an annular deforming or clamping member 35 having an inner end portion 40 which constitutes a flange and is slidable along the cylindrical internal surface of the sleeve 23. The left-hand end portion of the sleeve 23 has a counterbore which is surrounded by a cylindrical surface 36 having a diameter exceeding the outer diameter of the flange 40. The counterbore of the sleeve 23 receives a ring 37 which abuts against an internal shoulder or stop 48 of the sleeve 23 and includes a smaller-diameter inner end portion abutting against the flange 40. The cylindrical internal surface 38 of the ring 37 surrounds the complementary cylindrical external surface of the deforming member 35. The means for detachably coupling the ring 37 to the flange 40 of the deforming member 35 comprises tensioning screws or bolts 39 which are parallel to the common axis of the plug 25 and sleeve 23. The screws 39 cause the member 35 to urge the prongs of the chuck 32 against the cushion 29.

The holding device 41 includes an internal cylindrical portion 41*a* which spacedly surrounds the extension 26 and abuts against the outer end face of the chuck 32. The phantom line 41*b* denotes the axis of one of several screws which releasably secure the holding device 41 to the sleeve 23 during assembly of the roller and displacing component 24. When the flange of the holding device 41 abuts against the end face of the sleeve 23, the guide pin 42 extends into the blind bore 41*c* of the device 41. The holding device 41 is temporarily secured to the sleeve 23 prior to introduction of tensioning screws 39 whereby the holding device insures that the chuck 32 maintains the cushion 29 in prestressed condition. The tensioning screws 39 can be inserted into the interior of the sleeve 23 through cutouts or openings 43 in the flange of the holding device 41. Thus, when the parts 23, 25 and 41 assume the positions which are shown in FIG. 2, the cushion 29 is already under a predetermined initial stress to thereby insure that it invariably remains in contact with the adjacent cylindrical surfaces 30 and 31. The chuck 32 is thereupon fixed in the axial position shown in FIGS. 2 and 3 by screws 45 whose heads engage the outer sides of radially outwardly extending portions or lugs 46 of the outer part of the chuck. The threaded shanks of the screws 45 extend with clearance through holes in the respective lugs 46 and into tapped bores 44 of the ring 37. Thus, once the screws 45 are caused to mesh with the ring 37, the parts 37, 32 and 35 constitute a rigidly assembled group of elements between the sleeve 23 and the cushion 29. Such group of elements can be said to form part of the roller including the sleeve 23 and trunnion 37.

The holding device 41 is thereupon removed and is replaced with the trunnion 27 which is affixed to the sleeve 23 by the aforementioned threaded fasteners 28. Prior to attachment of the trunnion 27, a distancing ring 47 is inserted into the counterbore of the sleeve 23 to abut against the outer end face of the ring 37. The distancing ring 47 insures that the ring 37 remains in abutment with the internal shoulder or stop 48 of the sleeve 23.

The other end portion of the displacing component 24 can be mounted in the sleeve 23 in similar fashion. The cushion 29 allows for axial and/or radial movements of the extension 26 with respect to the sleeve 23, and the initial deformation or stressing of the cushion 29 is sufficient to insure that it remains in full contact with the cylindrical surfaces 30 (component 24) and 31 (roller) irrespective of the extent of radial and/or axial movements of the extension 26 with respect to the sleeve 23 and/or vice versa.

The rotary unit of FIGS. 2 and 3 exhibits the advantage that it employs a single and very simple (hollow cylindrical) cushion 29. Moreover, the deformable chuck 32 renders it possible to accurately select the initial stressing of the cushion 29. The thickness of the cylindrical cushion 29 can be readily selected in such a way that it allows for radial as well as necessary axial movements of the extension 26 of the displacing component 24 with respect to the sleeve 23. Moreover, and since the length of the chuck 32 exceeds the length of the cushion 29, the position of this cushion (as considered in the axial direction of the extension 26) need not be selected with a high degree of precision. A further advantage of the rotary unit of FIGS. 2 and 3 is that one side of the cylindrical cushion 29 abuts directly against a cylindrical surface 30 of one (24) of the two components. Since the components are normally large and bulky, it is simpler to provide such components with cylindrical surfaces instead of conical surfaces (13 and 14) of the type shown in FIG. 1.

The mounting of the cushion 29 between the smaller-diameter extension 26 of the displacing component 24 and the sleeve 23 is desirable and advantageous because this provides ample room for installation of other parts, i.e., of the parts 32, 35 and 37 which can be said to form part of the roller (when the rotary unit is fully assembled) and serve to bias the cushion 29 against the external surface 30 of the extension 26. Also, proper deformation of the chuck 32 presents no problems in view of the large annular space between the extension 26 and the internal surface of the sleeve 23.

The ring 37 exhibits the advantage that accurate machining of its internal surface 38 which engages the external surface of the deforming member 35 is much simpler and less expensive than an equally accurate machining of the internal surface of the large and bulky sleeve 23. Moreover, the ring 37 serves as a means for holding the chuck 32 and the deforming member 35 in selected axial positions during replacement of the holding device 41 with the trunnion 27 and thereafter.

Figure 4:
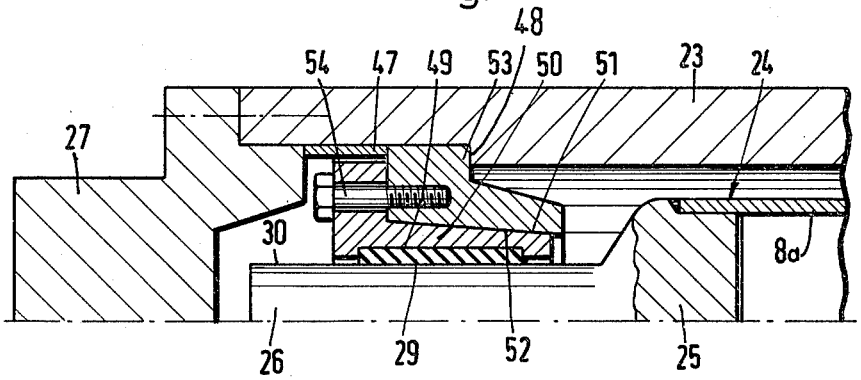
FIG. 4 is a fragmentary axial sectional view of a first modification of the rotary unit of FIGS. 2 and 3 wherein the chuck is urged against the cylindrical cushion by modified deforming means.

In the rotary unit of FIG. 4, the parts which are identical with or clearly analogous to corresponding parts of the rotary unit of FIGS. 2–3 are denoted by similar reference characters. Thus, the roller comprises a cylindrical sleeve 23 and two trunnions one of which is shown at 27, and the displacing component 24 comprises a tubular element 8a and two end portions or plugs one of which is shown at 25 and comprises a coaxial extension 26. The compensating device includes a hollow cylindrical cushion 29 which is disposed between the cylindrical external surface 30 of the extension 26 and the cylindrical internal surface 49 of a composite chuck 50. The conical external surface 51 of the chuck 50 abuts against the complementary conical internal surface 52 of a clamping or deforming member 53 which replaces the parts 35 and 37 of FIGS. 2–3. The parts 50 and 53 are held together by tensioning screws 54 which cause the prongs of the chuck 50 (i.e., the internal surface 49) to bear against the external surface of the cylindrical cushion 29, the same as in the embodiment of FIGS. 2–3. During application of tensioning screws 54, the chuck 50 moves axially inwardly, i.e., deeper into the interior of the deforming member 53. The distancing ring 47 maintains the deforming member 53 in abutment with the internal shoulder or stop 48 of the sleeve 23.

The parts 50 and 53 can be said to form part of the roller, i.e., the cushion 29 is inserted (in prestressed condition) between the cylindrical surface 30 of the displacing component 24 and the cylindrical surface 49 of the roller.

Figure 5:
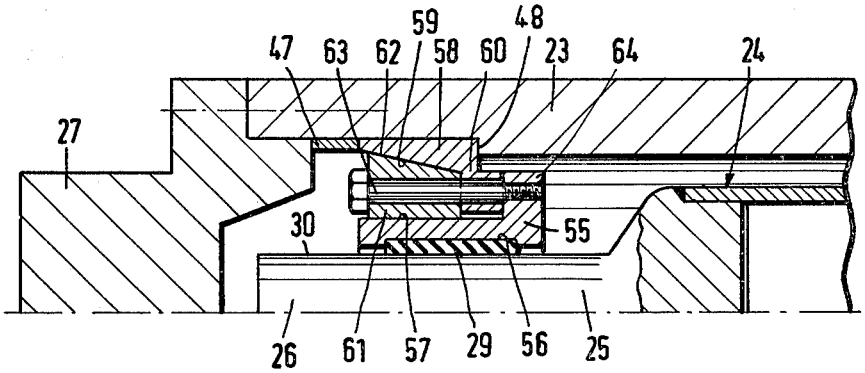
FIG. 5 is a fragmentary axial sectional view of a second modification of the rotary unit of FIGS. 2 and 3 wherein the chuck comprises two ring-shaped portions.

In the rotary unit of FIG. 5, the compensating device including the hollow cylindrical cushion 29 is surrounded by the prongs of a composite inner ring-shaped portion 55 of a two-piece chuck. The portion 55 of the chuck has a cylindrical internal surface 56 which is in permanent contact with the cushion 29, and a cylindrical external surface 57. A ring-shaped deforming member 58 is inserted into the counterbore of the sleeve 23 and has a conical internal surface 59 which abuts against the conical external surface 62 of a second ring-shaped portion 61 of the chuck. The portion 61 abuts against the cylindrical external surface 57 of the chuck portion 55. The inner end portion 60 of the deforming member 58 constitutes a holding collar which is disposed between a flange 64 of the chuck portion 55 and the adjacent inner end face of the chuck portion 61. The heads of tensioning screws or bolts 63 are adjacent to the outer end face of the chuck portion 61, and their shanks extend into tapped bores of the flange 64. When the screws 63 are driven home, the chuck portion 61 is moved axially inwardly (i.e., deeper into the sleeve 23) while the flange 64 abuts against the collar 60 so that it is held against axial movement. The chuck portion 61 bears against the prongs of the chuck portion 55 and causes the cylindrical surface 57 to bear against the cushion 29 which is biased against the cylindrical surface 30 of the extension 26. If desired, the chuck portion 61 can be formed with radially extending slots to enhance its deformability and hence its deforming action upon the chuck portion 55 while the conical surface 62 slides along the complementary surface 59.

The parts 55, 61, 58 can be said to form part of the roller, i.e., the cushion 29 is held (in prestressed condition) between the cylindrical surface 30 of the displacing component 24 and the cylindrical surface 56 of the roller. The trunnion 27 causes the distancing ring 47 to maintain the deforming member 58 in engagement with the shoulder or stop 48 of the sleeve 23.

An advantage of the rotary unit of FIG. 5 is that, once the inner ring-shaped portion 55 of the two-piece chuck and the deforming member 58 are inserted into the sleeve 23, the portion 55 need not move axially of the extension 26 during the application of tensioning screws 63. Thus, the outer ring-shaped portion 61 of the chuck merely slides with respect to the portion 55 and deforming member 58 so that the cushion 29 need not travel lengthwise of the extension 26. This is desirable because the frictional engagement between the cushion 29 and the surface 30 of the extension is very pronounced, at least during the final stage of application of the screws 63. The collar 60 of the deforming member 58 serves as a means for holding the portion 55 of the chuck against axial movement in a direction to the left during introduction of the portion 61, i.e., while the conical surface 62 slides along the complementary conical surface 59.

Figure 6:
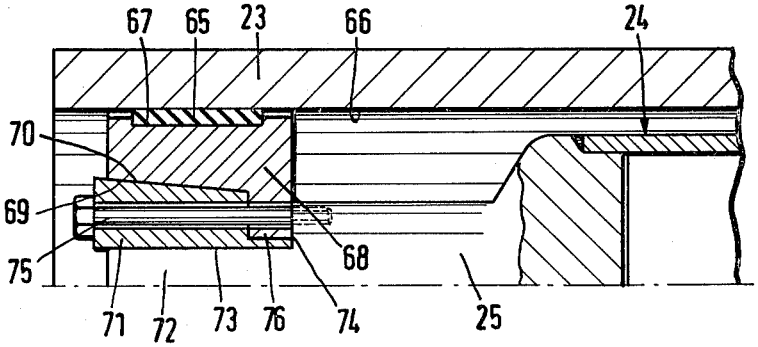
FIG. 6 is a fragmentary axial sectional view of a third modification of the rotary unit of FIGS. 2 and 3 wherein the chuck is surrounded by the cylindrical cushion.

The rotary unit of FIG. 6 comprises a compensating device including a hollow cylindrical cushion 65 which is in contact with the cylindrical internal surface 66 of the sleeve 23. The internal surface of the cushion 65 is in permanent contact with the cylindrical external surface 67 of a composite chuck 68 having a conical internal surface 69 abutting against the complementary conical external surface 70 of a ring-shaped deforming member 71. A smaller-diameter cylindrical extension 72 of the plug 25 of the displacing component 24 has a cylindrical external surface 73 in contact with the cylindrical internal surface of the deforming member 71. The shoulder or stop 74 at the inner end of the extension 72 serves as an abutment for the inwardly extending collar 76 of the chuck 68 and for the inner end face of the deforming member 71 in fully assembled condition of the means for biasing the cylindrical cushion 65 against the internal surface 66 of the sleeve 23. The tensioning screws 75 mesh with the plug 25 and bias the parts 71, 76 against the shoulder 74 to thus expand the prongs of the chuck 68 (i.e., the cylindrical surface 67) into deforming engagement with the internal surface of the cushion 65. During application of the tensioning screws 75, the conical surface 70 of the deforming member 71 slides along the conical internal surface 69 and expands the prongs of the chuck 65. The chuck 65 cannot yield by moving axially inwardly because it is held by the shoulder 74.

In this rotary unit, the chuck 68 and the deforming member 71 can be said to constitute two parts of the displacing component 24, i.e., the cylindrical cushion 65 is maintained in prestressed condition between a cylindrical surface 66 of the roller and a cylindrical surface 67 of the displacing component 24.

Figure 7:
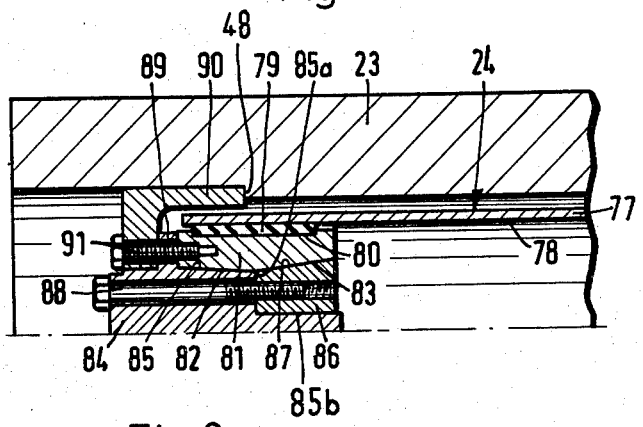
FIG. 7 is a fragmentary axial sectional view of a fourth modification of the rotary unit of FIGS. 2 and 3 wherein the cylindrical cushion is installed in the interior of a tubular element forming part of the displacing component.

In the rotary unit which is shown in FIG. 7, the displacing component 24 comprises a tubular element 77 having a cylindrical internal surface 78 which is in permanent contact with the external surface of a hollow cylindrical cushion 79 which constitutes the compensating device. The internal surface of the cushion 79 is in permanent contact with the cylindrical external surface 80 of a composite chuck 81. The internal surface of the chuck 81 is composed of two conical sections 82, 83 which are inclined in opposite directions. A holding means or insert 84 has a conical external surface 85 which is complementary to and contacts the left-hand conical section 82 of the internal surface of the chuck 81. The conical surface 85 is located outwardly of a radially inwardly extending shoulder 85*a* of the insert 84, and the latter is further formed with a cylindrical surface 85*b* which is located inwardly of the shoulder 85*a*. The deforming member 86 has a conical external surface 87 which abuts against the right-hand conical section 83 of the internal surface of the chuck 81. The tensioning screws 88 (only one shown in FIG. 7) connect the insert 84 with the deforming member 86. During the application of screws 88, the conical external surface 87 of the deforming member 86 slides along the conical section 83 of the internal surface of the chuck 81 to expand the prongs of the chuck into deforming engagement with the cushion 79 so that the latter is in permanent contact with the chuck and with the tubular element 77 regardless of eventual stray (radial) movements of the displacing component 24 in the sleeve 23. The chuck 81 cannot move axially outwardly during the application of tensioning screws 88 because it abuts against a circumferential flange 89 of the insert 84. Once the screws 88 are applied, the displacing component 24 is secured to the sleeve 23 by means of a retaining ring 90 which abuts against an internal shoulder or stop 48 of the sleeve 23 and is separably connected to the chuck 81 by screws 91. In the next step, the operators attach the trunnion (not shown in FIG. 7) to close the left-hand end of the sleeve 23.

The insert 84, chuck 81 and deforming member 86 can be said to constitute parts of the roller and are secured to the sleeve 23 by the retaining ring 90 and screws 91. Thus, the cylindrical cushion 79 is stressed by and is held between a first cylindrical surface 80 of the roller and a second cylindrical surface 78 of the displacing component 24.

An advantage of the rotary unit of FIG. 7 is that the parts 81, 84 and 86 can be assembled with the displacing component 24 prior to insertion of the component 24 into the sleeve 23. In the next step, the parts 81 and 84 are connected with the sleeve 23 by the retaining ring 90 and screws 91.

Figure 8:
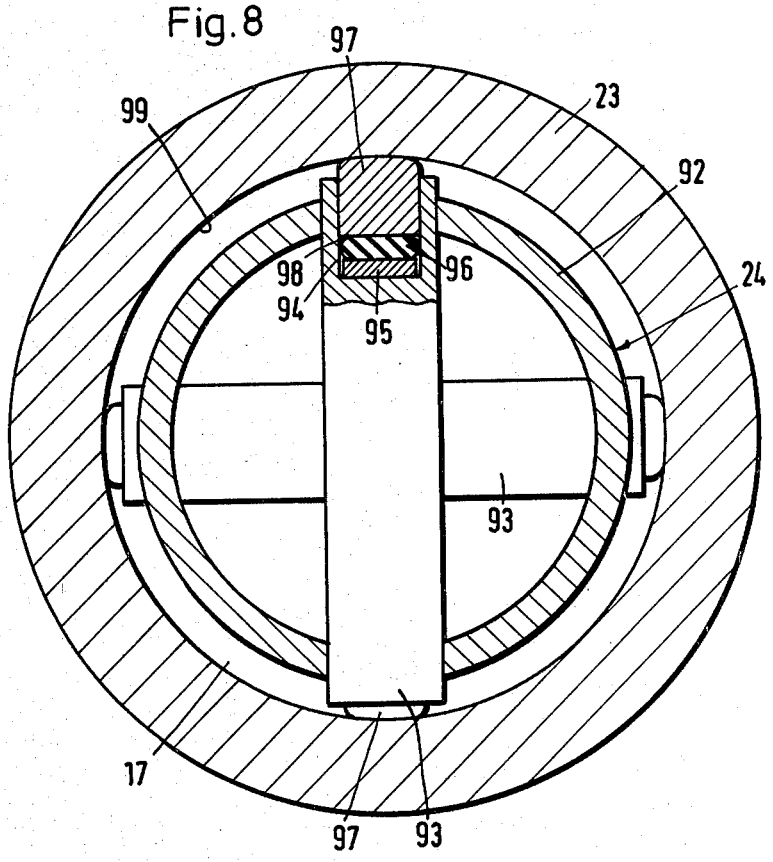
FIG. 8 is a transverse sectional view of a further rotary unit wherein the compensating means comprises several disk-shaped cushions mounted in the outer end portions of carriers which are secured to the displacing component.

In the embodiment of FIG. 8, the compensating device including a one-piece (circumferentially complete) cushion (12, 29, 65 or 79) is replaced with a compensating device having several discrete cushions 96. The tubular element 92 of the displacing component 24 is connected with several diametrically extending carriers 93 for pairs of discrete cushions 96. The end portions of the carriers 93 have end faces formed with recesses 94 whose innermost portions receive plate-like supports 95 for the respective cushions 96. The recesses 94 may constitute blind bores, and each of the cushions 96 then resembles a disk which abuts against the exposed outer surface of the respective disk-shaped support 95. The cushions 96 are inwardly adjacent to radially movable deforming members in the form of plungers 97 which abut against the cylindrical internal surface 99 of the sleeve 23.

When the rotary unit of FIG. 8 is fully assembled, each of the cushions 96 is subjected to a pronounced deforming stress; nevertheless, the initial stress upon the cushions 96 does not suffice to completely fill the portions 98 of recesses 94 between the respective supports 95 and deforming plungers 97. Such complete filling of the portions 98 would render the compensating device rigid, i.e., there would be no room for eventual radial movements of the carriers 93 with respect to the sleeve 23.

As shown in FIG. 8, each end portion of the tubular element 92 can be connected with two carriers 93 disposed at right angles to each other so that the internal surface 99 at the respective end of the sleeve 23 is contacted by four deforming plungers 97 each of which is in permanent contact with a prestressed cushion 96. The carriers 93 can be welded to, shrunk onto or otherwise rigidly connected with the tubular element 92. It is also sufficient, at least in certain instances, to provide a single carrier 93 at each axial end of the tubular element 92 and to mount the two carriers in such a way that they cross each other in space.

The necessary initial stressing of the cushions 96 can be achieved by forming the internal surface 99 of the sleeve 23 with outwardly flaring conical end portions so that the deforming plungers 97 are caused to move radially inwardly and to deform the respective cushions 96 during insertion of carriers 93 into the sleeve 23. The volume of the portions 98 of the recesses 94 is selected in such a way that, when the rotary unit of FIG. 8 is fully assembled, the unoccupied portions 98 are filled with the material of the respective cushions 96 before the one or the other end of a carrier 93 strikes against the internal surface 99 of the sleeve 23. In other words, the cushions 96 cannot undergo such deformation as is necessary to allow for direct contact between the sleeve 23 and the carriers 93.

The deforming plungers 97 can be said to constitute parts of the roller, and the carriers 93 and supports 95 can be said to form parts of the displacing component 24. Thus, the cushions 96 are installed between a substantially cylindrical interrupted surface (inner end faces of plungers 97) of the roller and a substantially cylindrical interrupted surface (outer sides of supports 95) of the displacing component 24.

Each carrier 93 can be replaced with two discrete carriers which extend radially or substantially radially of the sleeve 23. In such embodiment of the rotary unit, each carrier confines a single disk-shaped or otherwise configurated cushion 96. Carriers which extend diametrically of the tubular element 92 are preferred at this time because they can be installed with little loss in time and enhance the stability of the displacing component 24. If the tubular element 92 of the displacing component 24 moves axially of the roller, the plungers 97 slide along the internal surface 99 of the sleeve 23. The cushions 96 insure that each plunger 97 remains in permanent contact with the surface 99.

Figure 9:
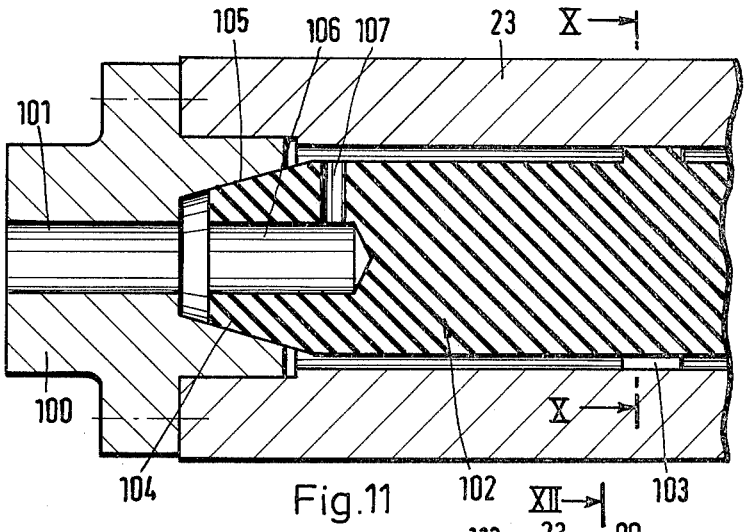
FIG. 9 is a fragmentary axial sectional view of a rotary unit wherein the displacing component is integral with several cushions one of which engages one of the trunnions and the others of which engage the internal surface of the sleeve.
Figure 10:
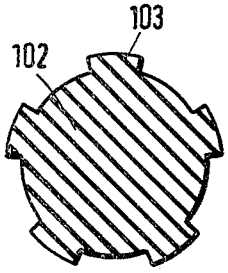
FIG. 10 is a sectional view of the displacing component and of one annular set of cushions as seen in the direction of arrows from the line X—X of FIG. 9.

FIG. 9 shows a portion of a rotary unit having a roller which includes a cylindrical sleeve 23 and two trunnions one of which is shown at 100. The trunnion 100 has an axial channel 101 for admission of a fluid heat exchange medium. Such medium may be a coolant or a heating fluid, the same as in each other embodiment of the invention. The entire displacing component 102 consists of elastomeric material and is a one-piece body which is received in the sleeve 23 with a certain clearance. The component 102 is integral with a compensating device including several elastic cushions 103 (see also FIG. 10) in the form of short protuberances extending in parallelism with the axis of and bearing against the internal surface of the sleeve 23. The cushions 103 are spaced apart from each other, as considered in the circumferential direction of the displacing component 102, and the latter can carry two or more annuli or sets of cushions 103, such annuli being spaced apart from each other as considered in the axial direction of the sleeve 23.

Each end portion 104 of the displacing component 102 also constitutes a cushion and its conical external surface is in permanent contact with the entire conical internal surface 105 of the respective trunnion 100. The heat exchange medium which is admitted via channel 101 flows into a blind axial bore 106 of the end portion or cushion 104, thereupon through one or more radially extending passages or bores 107 of the end portion 104, through the clearance between the sleeve 23 and the displacing component 102, and issues from the roller by way of the other trunnion. The direction of fluid flow can be reversed, i.e., the heat exchange medium can enter through the (non-illustrated) right-hand trunnion and issues from the roller via channel 101.

The mounting of the displacing component 102 is such that its cushions 103 and 104 are subjected to an initial stress to thus insure that the outer end faces of the cushions 103 invariably bear against the internal surface of the sleeve 23 and that the end portions 104 invariably bear against the entire internal conical surfaces 105 of the respective trunnions 100. Such initial stressing can be readily achieved by appropriate selection of the length and diameter of the displacing component 102 and/or by appropriate selection of the distance between the trunnions 100.

Figure 11:
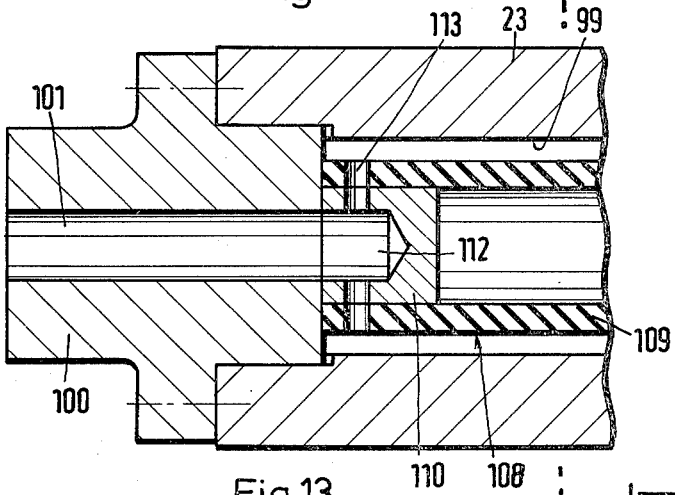
FIG. 11 is a fragmentary axial sectional view of a rotary unit which constitutes a first modification of the unit of FIGS. 9 and 10.
Figure 12:
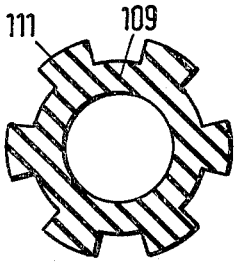
FIG. 12 is a sectional view of the displacing component as seen in the direction of arrows from the line XII—XII of FIG. 11.

In the embodiment of FIGS. 11 and 12, the displacing component 108 comprises a tubular element 109 of elastomeric material and metallic plugs 110 (one shown) which are fitted into the respective end portions of the element 109. The element 109 has several external ribs 111 (see FIG. 12) extending in parallelism with the axis of the sleeve 23 and constituting cushions which are in permanent contact with the internal surface 99 of the sleeve. The necessary initial stressing of the cushions or ribs 111 can be achieved by appropriate selection of the length of the displacing component and of the distance between the trunnions 100. Axial stressing (shortening) of the tubular element 109 is possible and advisable but not absolutely necessary, as long as the cushions 111 bear against the internal surface 99 of the sleeve 23.

The fluid heat exchange medium which is to be circulated in the interior of the roller can be admitted via axial channel 101 of the illustrated trunnion 100 to flow into the axial blind bore 112 and thence into radially outwardly extending passages 113 machined into the plug 110 and the corresponding end portion of the tubular element 109. The medium then flows between the cushions or ribs 111 toward the other trunnion of the roller. It will be noted that the cushions 111 divide the clearance between the element 109 and the internal surface 99 of the sleeve 23 into several elongated compartments wherein the heat exchange medium flows from the one toward the other end of the sleeve 23.

Figure 13:
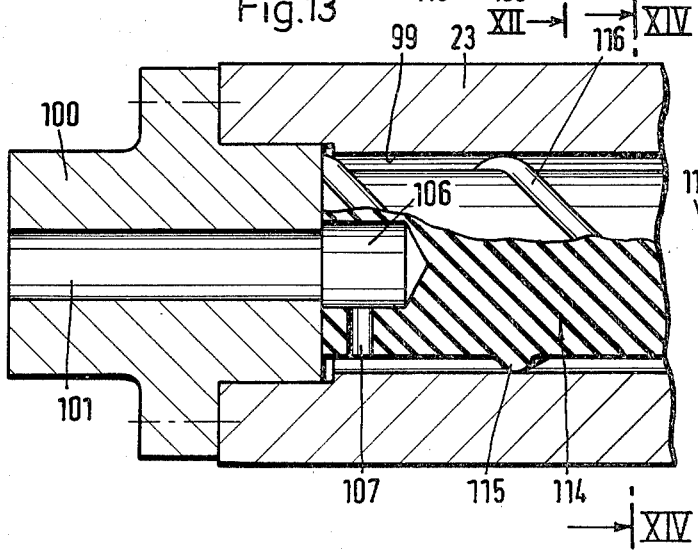
FIG. 13 is a fragmentary axial sectional view of a rotary unit which constitutes a second modification of the rotary unit of FIGS. 9 and 10.
Figure 14:
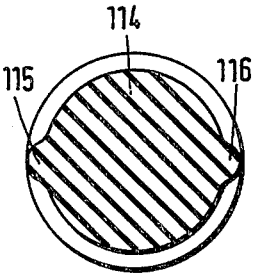
FIG. 14 is a sectional view of the displacing component as seen in the direction of arrows from the line XIV—XIV of FIG. 13.

In the embodiment of FIGS. 13 and 14, the displacing component 114 consists of elastomeric material and includes two cushions in the form of helical ribs 115, 116 which bear against the cylindrical internal surface 99 of the sleeve 23. The ribs 115, 116 bear against the surface 99 due to appropriate selection of the diameter of the displacing component 114 and/or as a result of axial stressing of the displacing component by the trunnions 100 (one shown in FIG. 13). The manner in which the fluid heat exchange medium is admitted into or evacuated from the roller (via channel 101 of the trunnion 100 and bore 106 and passages 107 in the displacing component 114) is the same as shown in and described in connection with FIG. 9.

The rotary units of FIGS. 9 to 14 exhibit the advantage that the displacing components and the compensating devices can be mass-produced at a lower cost. Moreover, the insertion and proper initial stressing of compensating devices which are integral with the respective displacing components is simpler and can be completed within short periods of time. Still further, and since the material of the major portion of or the entire displacing component is an elastomeric substance, the displacing component, too, can take up at least some deforming stresses when it moves radially and/or axially of the sleeve 23. Thus, the combined displacing component and compensating device of FIGS. 9–10, 11–12, or 13–14 can undergo much more pronounced deformation than a single cushion or a set of discrete disk-shaped or similarly configurated cushions. The rotary unit of FIGS. 9 and 10 exhibits the additional advantage that the end portion or cushion 104 of the displacing component 102 can readily take up substantial deforming stresses which develop in response to axial shifting of the displacing component in the sleeve 23.

The cushions and the elastically deformable displacing components can be made of any one of a variety of elastomeric materials, preferably elastomeric synthetic plastic substances such as fluorelastomers and butyl rubber. A suitable fluorelastomer is known as Viton (trademark) and is sold by Dupont. Best results are achieved with cushions having a Shore hardness of between 59 and 80, preferably approximately 65.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. In a rotary unit, such as a cylinder for use in calenders, the combination of a first component which constitutes a hollow roller including an elongated sleeve having first and second end portions, and first and second trunnions at the respective end portions; an elongated displacing component coaxially mounted in said roller and defining with said sleeve a clearance for the flow of a fluid heat exchange medium, at least one of said trunnions having channel means for admission of said medium into and for evacuation of said medium from said clearance, at least a portion of said displacing component being movable with respect to said first component in at least one of two directions including a first direction axially and a second direction radially of said sleeve; and compensating means including at least one prestressed elastic cushion interposed between said first component and said portion of said displacing component, said first component having a surface coaxial with said sleeve and in permanent contact with said cushion and said cushion being deformable in response to movement of said portion of said displacing component in said one direction.

2. The combination of claim 1, wherein said cushion is a hollow conical frustum and said surface is a first conical surface which surrounds said frustum, said displacing component having a second conical surface which is surrounded by said frustum.

3. The combination of claim 2, wherein said first conical surface is provided in said first trunnion.

4. The combination of claim 3, further comprising fastener means securing said first trunnion to said sleeve.

5. The combination of claim 1, wherein said cushion is a hollow cylindrical body and said surface is a first cylindrical surface, said displacing component having a second cylindrical surface and said body being disposed between and being in permanent contact with said cylindrical surfaces.

6. The combination of claim 5, wherein one of said components comprises a radially deformable chuck and the cylindrical surface of said one component is provided on said chuck.

7. The combination of claim 6, wherein said one component further comprises a deforming member for said chuck, said chuck and said member having contacting complementary surfaces coaxial with said sleeve and further comprising tensioning means for effecting relative movement between said chuck and said member to thereby deform said chuck in a direction radially of and against said cushion.

8. The combination of claim 7, wherein said displacing component comprises a cylindrical extension which is surrounded by said cushion.

9. The combination of claim 8, wherein said extension has a cylindrical external surface which constitutes said second surface.

10. The combination of claim 7, wherein said sleeve has a cylindrical internal surface which constitutes said first surface.

11. The combination of claim 7, further comprising a ring disposed within said sleeve and surrounding said chuck and said deforming member, said sleeve having an internal stop abutting against said ring.

12. The combination of claim 7, wherein said displacing component includes a tubular element having an internal surface which constitutes said second surface, said chuck and said deforming member being disposed within said cushion and further comprising an insert extending into said chuck and retaining means securing said insert to said sleeve.

13. The combination of claim 7, wherein said contacting complementary surfaces of said chuck and said deforming member are conical surfaces.

14. The combination of claim 7, wherein said deforming member has a cylindrical surface contacting said sleeve.

15. The combination of claim 7, further comprising means for holding at least a portion of said chuck against axial movement during relative movement between said chuck and said deforming member.

16. The combination of claim 15, wherein said tensioning means comprises threaded elements parallel to the axis of said sleeve and said holding means comprises a temporary closure connectable with said sleeve in lieu of one of said trunnions.

17. The combination of claim 15, wherein said chuck comprises two coaxial ring-shaped portions and said holding means comprises a collar provided on said deforming member and disposed between said portions of said chuck.

18. The combination of claim 15, wherein said displacing component comprises an extension coaxial with said sleeve and surrounded by said chuck and said deforming member, said extension including a shoulder which constitutes said holding means, said threaded elements extending through said chuck and said deforming member and into said extension.

19. The combination of claim 15, wherein said holding means comprises an insert which is surrounded by said chuck and said deforming member, said threaded elements extending through said insert and meshing with said deforming member.

20. The combination of claim 7, wherein said deforming member surrounds said chuck and said complementary surfaces are conical surfaces adjacent to one end portion and tapering toward the other end portion of said sleeve, said deforming member including a flange having tapped bores parallel to the axis of said sleeve, said tensioning means comprising threaded elements extending into said tapped bores and further comprising a ring outwardly adjacent to and biased by said elements against said flange.

21. The combination of claim 20 wherein said chuck comprises radially outwardly extending portions and further comprising means for securing said portions of said chuck to said ring.

22. The combination of claim 21, wherein said sleeve has an internal shoulder for said ring and further comprising distancing means interposed between said ring and one of said trunnions.

23. The combination of claim 1, wherein said displacing component comprises carrier means extending substantially radially of said sleeve and having an end portion adjacent to said sleeve, said end portion of said carrier means having a recess for said cushion.

24. The combination of claim 23, wherein said cushion is a disk, said first component including a plunger extending into said recess and bearing against said disk.

25. The combination of claim 23, wherein said carrier means includes a second end portion having a second recess located diametrically opposite said first mentioned recess, said compensating means comprising a second cushion in said second recess.

26. The combination of claim 23, wherein said carrier means is movable with said portion of said displacing component in the radial direction of said sleeve and said cushion partially fills said recess when said portion of said displacing component is coaxial with said sleeve but completely fills said recess before said carrier means contacts said sleeve.

27. The combination of claim 1, wherein said compensating means comprises a plurality of cushions integral with said displacing component.

28. The combination of claim 27, wherein said surface is the internal surface of said sleeve.

29. The combination of claim 27, wherein at least some of said cushions extend lengthwise of said sleeve.

30. The combination of claim 27, wherein at least the major part of said displacing component consists of elastomeric material.

31. The combination of claim 27, wherein one of said plurality of cushions has a conical external surface and said surface of said first component is a conical internal surface in one of said trunnions, said internal surface being in permanent contact with said external surface.

32. The combination of claim 27, wherein at least some of said cushions extend outwardly from said displacing component and across said clearance and are in permanent contact with said sleeve.

33. The combination of claim 27, wherein at least one of said cushions is a helical rib extending across said clearance and being in permanent contact with said sleeve.

* * * * *

UNITED STATES PATENT AND TRADEMARK OFFICE

CERTIFICATE OF CORRECTION

PATENT NO. : 4,235,002

DATED : November 25, 1980

INVENTOR(S) : Josef PAV, Michael JÄKEL, and Dieter JUNK

It is certified that error appears in the above-identified patent and that said Letters Patent are hereby corrected as shown below:

Foremost page, left-hand column,

Item [54], "CALENDARS" should read --CALENDERS--.

Signed and Sealed this

*Third* Day of *March 1981*

[SEAL]

*Attest:*

RENE D. TEGTMEYER

*Attesting Officer*

*Acting Commissioner of Patents and Trademarks*